United States Patent [19]

Madray

[11] Patent Number: 4,697,393

[45] Date of Patent: Oct. 6, 1987

[54] METAL BUILDING CONSTRUCTION

[76] Inventor: Herbert R. Madray, P.O. Box 712, Okeechobee, Fla. 33472

[21] Appl. No.: 709,317

[22] PCT Filed: May 22, 1984

[86] PCT No.: PCT/US84/00782

§ 371 Date: Jan. 22, 1985

§ 102(e) Date: Jan. 22, 1985

[87] PCT Pub. No.: WO84/04771

PCT Pub. Date: Dec. 6, 1984

Related U.S. Application Data

[63] Continuation-in-part of Ser. No. 496,960, May 23, 1983, Pat. No. 4,551,957.

[51] Int. Cl.[4] ..... E04B 1/38

[52] U.S. Cl. ..... 52/93; 52/721; 403/171

[58] Field of Search ..... 52/90, 92, 93, 94, 721, 52/478, 519; 403/170, 171, 174, 176, 178, 205, 295, 382, 403; 135/106

[56] References Cited

U.S. PATENT DOCUMENTS

| | | | |
|---|---|---|---|
| 2,574,074 | 11/1951 | Vogel . | |
| 3,304,683 | 2/1967 | Ferreira | 52/497 |
| 3,653,172 | 4/1972 | Schwartz | 52/669 |
| 3,787,130 | 1/1974 | Hemmings | 52/665 X |
| 3,890,755 | 6/1975 | Specht | 52/645 |
| 4,011,697 | 3/1977 | Fedolfi | 52/90 |
| 4,054,012 | 10/1977 | Paradisi et al. | 52/519 |
| 4,076,432 | 2/1978 | Glaser | 403/171 X |
| 4,142,335 | 3/1979 | Andrade | 52/90 |
| 4,205,497 | 6/1980 | Schirm | 52/90 |
| 4,275,534 | 6/1981 | Porter | 52/82 |
| 4,350,318 | 9/1982 | Gallis | 249/40 |
| 4,356,675 | 11/1982 | Reicherts | 52/90 X |
| 4,365,453 | 12/1982 | Lowe | 52/478 |

FOREIGN PATENT DOCUMENTS

| | | | |
|---|---|---|---|
| 3033114 | 3/1982 | Fed. Rep. of Germany . | |
| 743675 | 4/1933 | France | 135/106 |
| 1229153 | 9/1960 | France . | |
| 783403 | 9/1957 | United Kingdom | 52/721 |
| 1025751 | 4/1966 | United Kingdom | 52/93 |

*Primary Examiner*—J. Karl Bell

*Attorney, Agent, or Firm*—Steele, Gould & Fried

[57] ABSTRACT

A metal building construction system includes a plurality of interfitting components for general purpose building requirements. Channel members of "C"-shaped cross-section define studs, headers and joists which are interconnected by means of adapters at the eaves and roof ridge. The adapters and channel members are attachable to one another at repetitive patterns of connection holes. The repetitive patterns of holes are also provided for engagement with siding and roofing, each of which has correctly-dimensioned structure for engaging the repeating patterns of holes and also for engaging a successive strip of such siding and roofing. Structural braces are also provided, as well as trim and incidental devices adapted for interconnecting certain specific parts, whereby a general purpose system applicable to a wide range of dimensions and designs is possible.

10 Claims, 21 Drawing Figures

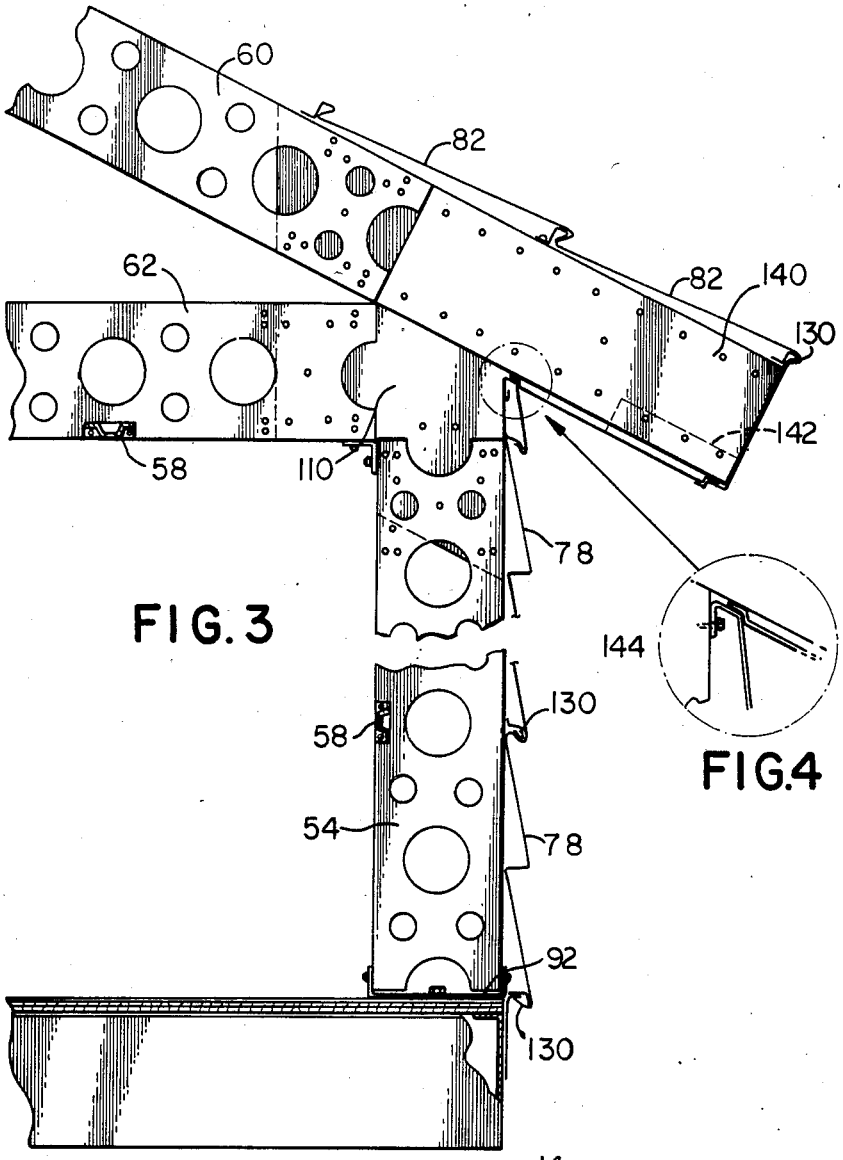
FIG. 3
FIG. 4
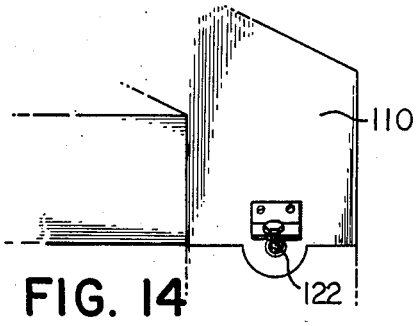
FIG. 14
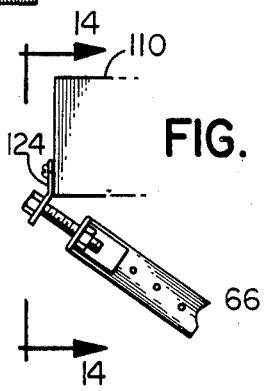
FIG. 13

FIG. 17
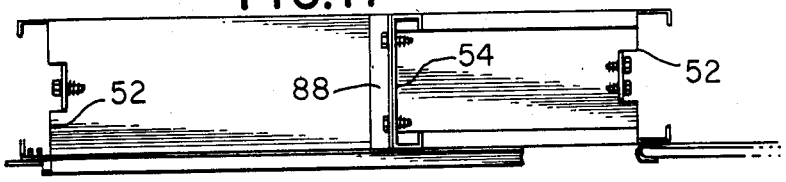
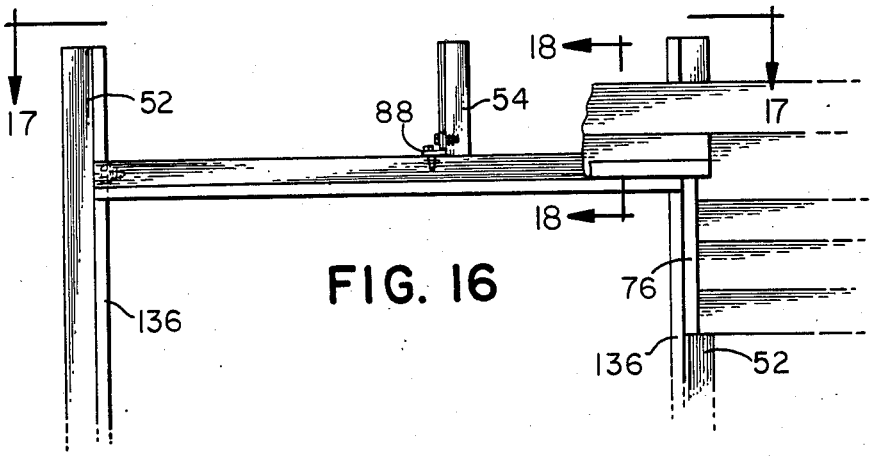
FIG. 16
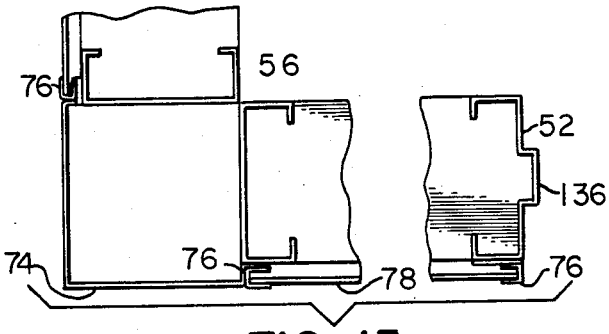
FIG. 15
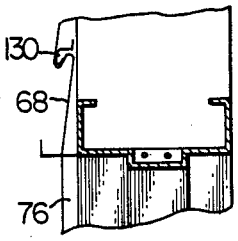
FIG. 18
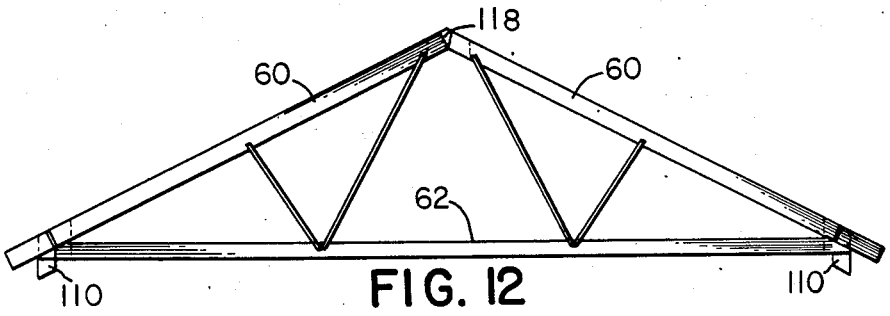
FIG. 12

METAL BUILDING CONSTRUCTION

CROSS REFERENCE TO RELATED APPLICATION

This is a continuation-in-part of application Ser. No. 496,960, filed May 23, 1983, now U.S. Pat. No. 4,551,957.

BACKGROUND OF THE INVENTION

1. Field of the Invention

This invention relates to the field of building construction, and in particular to a system of standardized matched components for metal framing and finishing of structures, for universal application and adapted to achieve a traditional external appearance.

2. Description of the Prior Art

A number of construction systems have been conceived which purport to be based upon a limited number of standardized elements. Similarly, metal building construction has been attempted using durable metal frame pieces, for example, extruded beams, studs and the like. The prior art systems include many conveniences of manufacture or interconnection applicable to a limited range of structural designs. The known systems, however, have been impractical for building houses and the like for more universal design, especially according to high-quality traditional layouts, which vary widely. The prior art systems have lacked either the convenience of complete standardization and few parts, or on the other hand, have been so standardized as to make them useful for only a few certain types of buildings, for example, simple box-like structures.

In U.S. Pat. No. 3,001,615, metal studding is disclosed to include structure for supporting lengths of interior wall panel. The studs are adapted to fit endwise into upwards and downwards facing channel members of U-shaped cross-section. Such metal studding is well known and useful to replace less durable wood studding, but is not well adapted for bearing structural loads efficiently. Moreover, the known studding designs must be custom fitted by the installer, and unlike the present invention, lack dimensional inter-relationships with a variety of further parts of the building.

U.S. Pat. No. 2,035,697—Felber teaches a building construction in which joists are bolted or pivotally connected to a junction of vertical studs and horizontal headers. The joists are connected endwise to one another in pairs by a member at the junction along a roof ridge. Pivotal connections are relatively easily made, but concentrate loads at the pivot, and also allow some relative movement of connected parts. Similarly, connections which are based entirely on bolts, rivets or the like depend heavily on the connection elements to bear loads. The studs, joists and beams of Felber are made of pre-cast concrete, rather than metal. Such a system is unwieldy for structures on the range of dwellings and also lacks a standardized interconnection scheme for various other necessary parts such as siding elements, roofing elements, interior fixtures and trim.

U.S. Pat. Nos. 2,095,434—Calkins, et al., and 2,023,814—Lindsey, concern small-scale metal structures, having a simple external appearance quite unlike the traditional family home. Such structures have recently become popular as backyard outbuildings and utility shacks for various uses. The structures are characterized by the interconnection of panels according to a strict and invariable design rather than the more variable building of a frame of studs, joists and headers to be externally covered by siding and roofing, and internally by wallboard and trim elements. The structures of these shacks are convenient for interconnection of parts, but are so fully specified that their benefits cannot be readily extended to varied structural and external features typical of traditional homes.

U.S. Pat. No. 1,893,636—Ridgway uses metal members to frame houses in an attempt to provide more or less conventional structures which benefit from durable metal framing elements. The Ridgway framing system, however, is based upon combinations of individual rectangular modules in the manner of framing panels which are placed side to side and one atop another, and are connected to form larger panels by a plurality of clamps connecting abutting panel frames.

The art of building construction is quite developed in terms of building structures to support loads, interconnection of beams and other elements, and prefabrication of elements. In an effort to maximize convenience of construction, the art has turned to systems which are non-standard for practical purposes. Fully prefabricated modular systems detract from the designer's options in varying the possible layout and design to be executed. The present invention departs from the prior art's use of fully prefabricated modular elements, and instead relies upon a novel connection of improved framing elements and surface forming elements which are universally interconnectable. The parts all are dimensioned such that they are connectable at any of a plurality of incremental relative positions by means of repeating patterns of connection holes. The structure of the invention is therefore prefabricated in the sense that all the parts are standardized and interfittable. At the same time the invention is universal because although the parts are prefabricated, they can be practically connected in innumerable ways along the complementary dimensioned interconnections to form innumerable different structures.

The basic element of the invention, a channel member having a squared-off "C"-shaped cross-section, functions as stud, joist and header. Adapters for connecting the channel members at the eaves and at the roof ridge fit snugly within the C-shaped cross-section and engage the full inner surface of the channel member, whereby the structure bears loads far in excess of what may be expected from connections relying only on bolts or like connection elements. In fact, the elements share structural loads and are therefore much stronger than known prefabricated systems, conventional metal stud systems, and the like.

Both the siding and roofing are comprised of strip elements which may be serially connected along interfitting edges. Each strip has a first edge defining a protrusion, a second edge defining a receptacle, and an attachment flange which is affixed to the frame element, then covered by a successive strip. An engagement structure, including the same form of protrusion, is provided on starting elements for the siding and for the roofing, for example, at the lower edge of the siding and at the lower edge of the roof eaves. The required structure is thus repeated from the starting elements to the upper edge of such siding and/or roofing strip.

According to the invention, the builder is provided with a series of matched interfitting elements which can be combined as desired to correspond in part to traditional elements such as studding, siding and roofing.

The builder can therefore produce virtually any required structure. The elements, however, are stronger and more conveniently used than either traditional or formerly known prefabricated structures due to the standardized dimensions and spacing of elements that allows the wide range of structures to be accomplished, with virtually no custom fitting of parts, no cutting and no need to provide aligned holes for attachments. The result is a durable and attractive structure benefitting from the best features of prefabrication and the best of custom design. An external appearance characteristic of the most artful traditional building is provided, together with the great durability and strength of a beamed metal structure. Not only the roofing, siding and external portions, but the internal wall and trim portions as well benefit from the plan of interfitting parts and fittings, which truly facilitate a standardized construction.

SUMMARY OF THE INVENTION

It is an object of the invention to provide a building system which produces a wide variety of structurally strong and durable buildings using matched parts, standardized for easy and inexpensive assembly.

It is also an object of the invention to standardize conventional constructions based upon adapting building construction elements of a general type traditional to single-family and moderate-sized buildings, using very durable metal construction elements which are universally interconnectable at any required alignment and spacing.

It is another object of the invention to provide a building system in which more durable elements than conventional building elements are made easily and precisely interconnectable at required alignments, by use of a minimum number of additional elements which fully engage abutting parts at specific interconnection points, pemitting very strong high-speed, and very precise construction at any of an immense plurality of predetermined incremental sizes and shapes of buildings.

It is a further object of the invention to provide a full-scale building system that is likewise applicable to reduced scale educational toys, architectural models and building training devices.

It is yet another object of the invention to provide a system for producing structures of maximum durability and maximum variety, at minimum expense in parts and in labor for the interconnetion of parts.

These and other objects are accomplished by a metal building construction system including a plurality of interfitting components for general purpose building requirements. Channel members of "C"-shaped cross-section define studs, headers and joists which are interconnected by means of adapters at the eaves and roof ridge. The adapters and channel members are attachable to one another at repetitive patterns of connection holes. The repetitive patterns of holes are also provided for engagement with siding and roofing, each of which has correctly-dimensioned structure for engaging the repeating patterns of holes and also for engaging a successive strip of such siding and roofing. Structural braces are also provided, as well as trim and parts for adapting interconnecting certain specific parts, whereby a general purpose system applicable to a wide range of dimensions and designs is possible.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein:

FIG. 3 is a section view taken along lines 3—3 in FIG. 2;

FIG. 4 is an enlarged detail section view of the indicated portion of FIG. 3;

FIG. 12 is an elevation view of a reinforced joist and header structure;

FIG. 13 is a side view of a wind brace attachment;

FIG. 14 is an elevation view taken alone lines 14—14 in FIG. 13;

FIG. 15 is a partial section view of a corner of the building, taken along lines 15—15 in FIG. 2;

FIG. 16 is an elevation view of a partially-assembled door or window frame;

FIG. 17 is a view taken along lines 17—17 in FIG. 16;

FIG. 18 is a section view taken along lines 18—18 in FIG. 16;

DETAILED DESCRIPTION OF THE PREFERRED EMBODIMENTS

Figure 1:
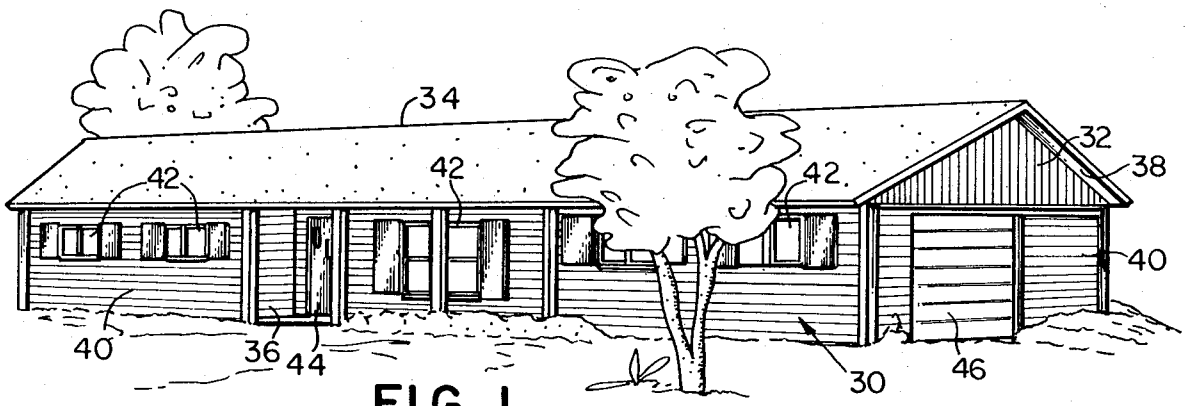
FIG. 1 is a perspective view of a finished structure according to the invention.

The system of the invention is useful for producing structures such as detached dwellings, according to traditional designs. The invention is illustrated, as in FIGS. 1 and 2, with reference to a traditional ranch design for a single family home, that is, a structure on one level. It should be appreciated that the system of the invention is likewise applicable to buildings with multiple stories, split levels, A-frame constructions and the like.

Finished structure 30, for example the ranch house shown, comprises a plurality of vertical walls on the sides and ends, sections of wall having interspersed windows and doors. Traditional construction details include a sloping roof rising to peak 34, a recessed wall portion 36 defining an entryway adjacent the door 44, and a number of trim features. Horizontally-aligned elongated siding panels 40 give the appearance of traditional horizontal wood slat siding, running along the sides of the house and between windows 42 and the various doors 44, 46. Door 46 is shown, for example, as a garage door on the end of the house, under gable 32.

An overhung edge of the roof is provided around the entire periphery, namely at eaves 38. Such an overhang occurs at both the sides and at the gabled end. Fascia coverings close spaces not directly covered by siding or roofing.

Figure 2:
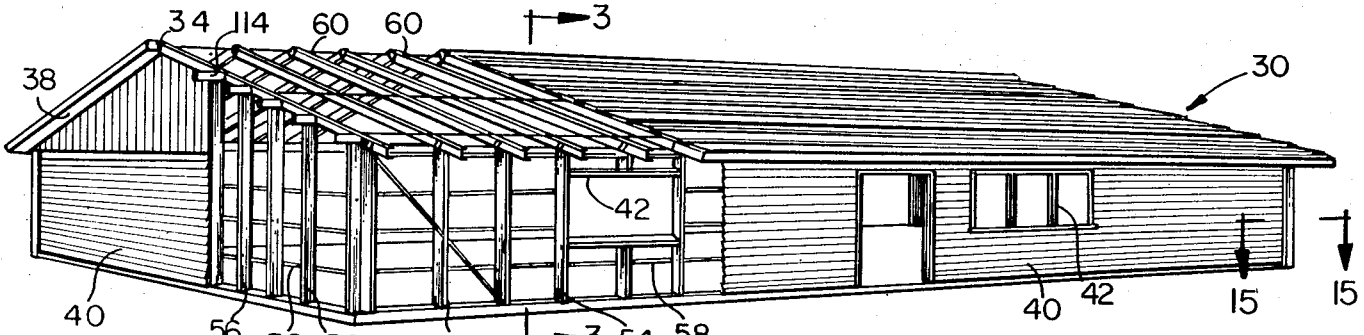
FIG. 2 is a perspective view of a stage in construction of a building according to the invention, showing some internal framing elements.

As shown in FIG. 2, the house is essentially supported by a series of spaced ribs, each of which has two joists 60, one header 62 and two studs 54, and which together define a skeleton. The studs 54 are spaced and attached together along the sides of the building to provide an integral structure by means of spreader bars 58, running horizontally between the studs. The studs associated with the sides of the house, that is, studs 54, are all of equal length. The studs 56 on the gable ends are of progressively longer length from the ends to the roof peak 34.

A number of the traditional features of the house 30 are based upon building construction considerations relating to the use of traditional building elements. Such features have come to be associated with quality construction, and although not strictly necessary for shelter or structural support, have come to be considered necessities for many buildings, such as dwellings. For example, the overhang 38 is useful to some extent to keep rain and the like from falling on the siding of the house. However, it is believed that the overhang developed over the years primarily as a result of convenience in attaching the joists and studs. Such an overhang is not strictly required in a metal framed system of building elements because the joists and studs are directly connectable. Nevertheless, such an overhang has come to be expected in quality constructions. Similar considerations apply to the overhangs at gable end and at the eaves. The system of the invention is particularly adapted to reflect the preferred traditional structure, notwithstanding the fact that the elements are universally interconnectable prefabricated metal elements.

Figure 5:
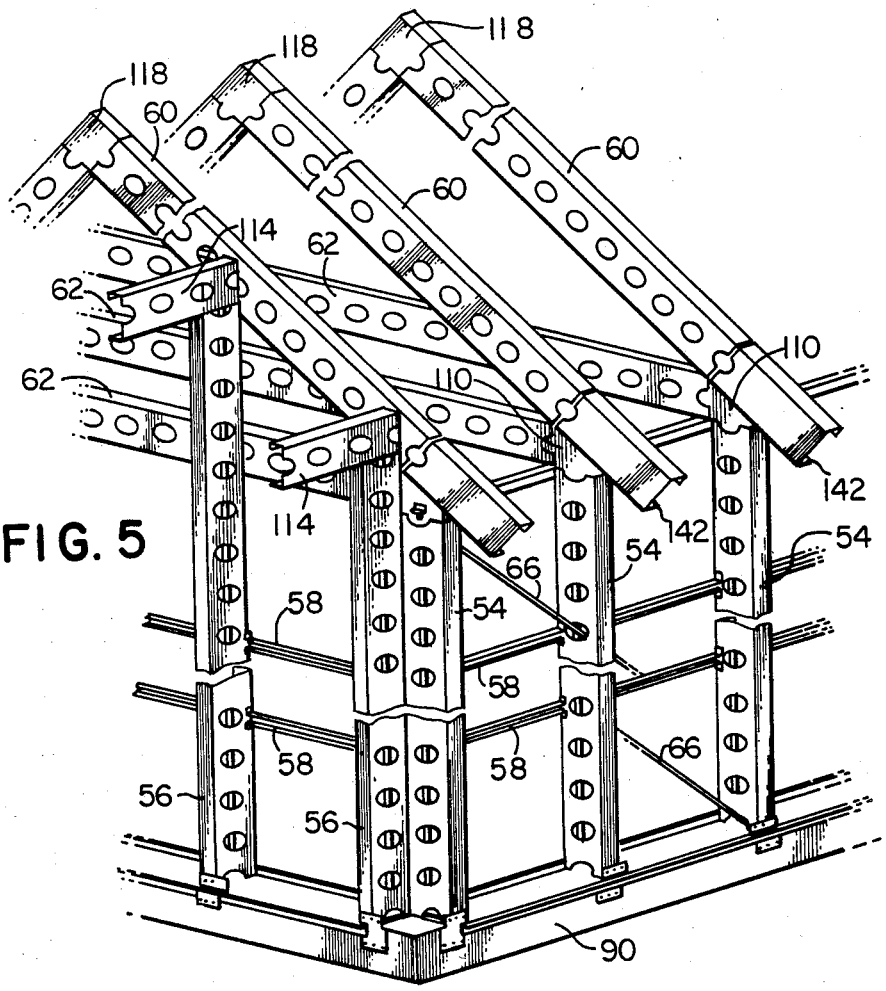
FIG. 5 is a partial perspective view of a stage of construction.

The overall structure 30 is supported by a skeleton of structural elements including side studs 54, headers 62 and joists 60. As shown in FIGS. 2, 3 and 5, a pair of joists 54 on opposite sides of the building are connected by means of a single header 62 and a pair of joists 60. The connection of the stud 54, header 62 and one of the joists 60 is accomplished by means of an inserted adapter element 110, whereby the abutting connections of the roof joists to studs and to a header is made unusually strong. A similar interconnection between the joists themselves along the roof ridge is accomplished by means of ridge adapter 118. The eaves adapter 110 and ridge adapter 118 cause an intimate mechanical interconnection of the C-channel members which are used for the headers, joists and studs, whereby the load-bearing capabilities of the channel members are effectively multiplied. This is accomplished because the intimate interconnection along the entire inner area of each C-channel permits the load to be shared between the connected structural elements rather than born only by the bolts or like connectors.

The unusual strength of the connected parts according to the invention allows building of relatively larger structures without need to incorporate additional bracing, and also permits use of fewer supporting frame elements for a structure of a given size, as compared to conventional building means. The studs 54, headers 62 and joists 60 are intimately connected to one another across a given width of the building. The studs are attached endwise to the foundation, and successively to one another. Therefore, each of the studs supports the usual compression load, and also tends to cooperatively bear loads transmitted from the other elements. Similarly, the headers support the usual tension load and also bear and transmit loads applied to the remaining elements. The full connections between the adapter elements and the frame elements fix the frame elements both in position and in relative orientation. The connections accordingly define a cantilevered structure in which virtually all the frame components are involved in supporting all parts of the load. This applies not only to support of dead weights of building materials, but also to variable loads such as wind, and vibrational or noise-causing forces of various descriptions.

Figure 7:
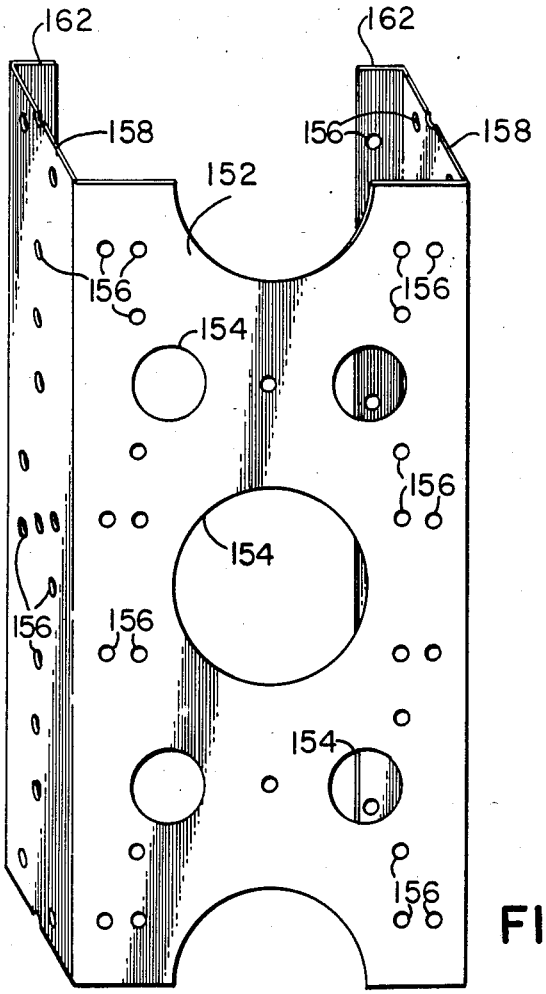
FIG. 7 is a perspective view of a segment of channel according to the invention.
Figure 11:
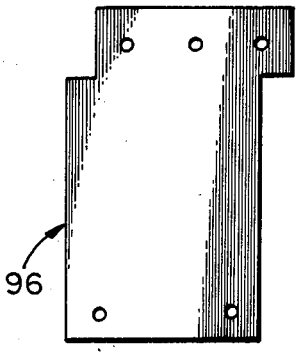
FIG. 11 is an elevation view of a stud bracket according to the invention.

FIG. 7 illustrates a length of channel material 150. The channel member comprises a wide face 152, preferably having a series of large openings 154 therein, to reduce the weight of the chanel member 150. Also provided are a plurality of connection holes 156 on wide face 152 and also side faces 158 and flanges 162. The connection holes are laid out to align with connection holes in each of the other pieces which interfit with the channel member. Accordingly, the channel material 150 can be provided in standard lengths, or if necessary, cut at any increment of the predetermined spacing of connection holes, and will interfit with all other parts of the system without the need to form new connection holes. Therefore, alignment is assured. The substantially-enclosed cross-section of the C-channel engages the outer surface of adapter elements inserted therein. The inserted elements may be the eaves adaptor 110 or ridge adapter 118, or a length of appropriately dimensioned inserted rectangular tubing can be inserted to connect lengths of channel end-to-end, etc.

With reference to FIG. 2, the side studs 54 are all of a standard length, for example eight feet, except at openings for windows 42. Likewise, the headers 62 are of a standard length, defined by the overall depth of the structure, as are joists 60. The gable end studs 56 are increasingly longer progressing from the corner to the peak, and the increment at which the connection holes repeat on channel material 150 is set to complement the standardized spacing of studs and the angles chosen for interconnection adapters 110 and 118.

The pitch of the joists can be varied among a series of angles which are related to the spacing of the gable end studs and the increment at which the connection holes repeat. The pitch as defined by eaves adapter 110 and ridge adapter 118 can be set to any angle at which the spaced studs will have connection holes aligned with the connection holes on the joists. Therefore, a given spacing of connection holes and a given spacing of studs will still allow a range of pitches. Assuming, for example, a six inch hole repeat and a two foot spacing, pitches having tangents of 6/24 (14°2′), 12/24 (26°34′), 18/24 (36°52′) will fit precisely correctly in the scheme of inter-related parts.

Building studs are traditionally located at 16 inch centers; the studs of the invention are preferably at two-foot centers, and this latter spacing is likewise well adapted for use with off-the-shelf finishing materials such as interior wall paneling (often four feet by eight feet) and the like. The joists 60 may be aligned with respect to the headers at a "standard" pitch angle defining a one-foot increase in height for every two feet along header 62, namely an angle of about 26 degrees, 34 minutes. In this manner, the two-feet centers of the studs, including gable end studs 58, translate into a need for studs 58 at one-foot incrementally larger lengths. All the joists 60 are aligned at the subject angle with respect to horizontal by virtue of eaves adapters 110. The joists are connected at the complementary angle, namely about 137 degrees, by roof ridge adapter 118. These angles of course remain the same regardless of the length of joists 60 and headers 62. Gable end studs 58 are thus merely provided at the one-foot incremental lengths required, at two-feet spacing, to frame out the entire structure. All portions of channel material are provided with repetitive patterns of attachment holes. The frequency of repetition is matched to the angle of the eaves and ridge adapter. It is presently preferred that the pattern repeat at a six inch interval, thereby matching the one foot joist increment and the two foot stud spacing by integer multiples.

An individual "rib" defined by a pair of connected joists 60, attached to a pair of studs 54 and a header 62, is precisely spaced from the next rib by means of spreader bars 58, which hold successive studs at two-foot centers. In particular, channel member 150 is preferably two inches wide along face 158, such that a spreader 58 having a twenty-two inch length precisely spaces the successive studs at two-foot centers. Spreader bars 58, as shown in cross-section in FIG. 3, may be lengths of simple angle iron having opened flanged ends with connection holes aligned to engage connection holes 156 on channel member 150. The spreader bars 58 are preferably included between side studs 54, between gable studs 58, and also between headers 62. The spreader bars may also include holes or other connection means for supporting internal fixtures such as wallboard and the like. Similarly, electrical and plumbing connections can be likewise dimensioned for use in said incremental lengths and attachment to the standard elements as above. It is presently preferred that the inner surfaces of the structure be insulated using polyurethane foam, and finished internally using conventional wood and plaster materials.

Wind braces 66, shown in FIGS. 5, 13 and 14, are provided to exert a diagonal force preventing the tendency of orthogonally-connected structures to pivot at their junctions. The wind braces may define structurally solid triangles. The braces may also be connected, for example, between eaves adapters 110 and intermediate areas along side studs 54. Clearance holes 122 are provided in the eaves adapters such that the wind brace 66 passes through the adapter 110 for an angular connection to a surface of the adapter, using an angled flange clip 124 and a bolt 126. In this manner, the brace 66 can be tensioned to resist any tendency of the structure to wobble, for example, under the stress of wind.

The lowermost edge of each of the studs 54, 56 is likewise anchored. As illustrated in FIGS. 3 and 5, it is presently preferred that the anchoring of the studs be accomplished together with a means for affixing the lowermost strip of siding. The structure is illustrated supported upon a concrete slab. It will be appreciated that a slab is not strictly necessary, and other structures which facilitate an endwise connection of studs 54, 56 can likewise be used for support, such as concrete footers, brick walls, lower levels of studding, framing elements of a different description, or the like. The structure will be described with reference to a foundation in the form of a concrete slab 90. In order to provide a secure endwise connection between studs 54, 56 and the concrete slab, connector bracket 96 is attached to the side of the stud, and also to the side of concrete slab 90, by means of connection holes provided in the bracket, aligning at least with the repetitive spaced holes of channel material 150. Bracket 96 affixes a short face 158 of the stud channel, and also to a side face of concrete slab 90, and the connection may be supplemented by use of a bracket having a L-shaped cross-section, the standing leg of the "L" being connected to an opposite end 158 of the channel, and also connected by means of a vertically oriented bolt into the top surface of slab 90. Such a connection is shown in FIG. 3.

According to a prior art structure having fasteners (e.g. nails) connecting elongated bodies such as studs and headers (e.g., of wood), a load such as wind will bear against the stud and will urge the structure toward collapse by urging the stud to fall over, that is, to rotate around its mounting to the floor. For example, if the structure of FIG. 3 was subjected to a load from the right, a resultant force would seek to move header 62 and joist 60 toward the left, and to rotate stud 54 to the left around its connection to slab 90. If the connections of joist, header and studs were each pivotal, the structure (a parallelogram in cross-section) would collapse easily. Although pivotal connection at the eaves would not be advisable, the typical builder according to the prior art would make the connection using only pin-like fasteners (e.g. screws or nails) running for the most part parallel to the pivot axis. The connection of the invention is superior because even without regard to fasteners (which are, of course, used), the full engagement of the inserted legs of rigid adapter 110 in the C-shaped channels of studs 54, header 62 and joists 60 will very strongly resist any such movement. Moreover, the channel is itself rigid such that the eaves adapters 110 on both sides of a header 62 tend to share any loading.

Figure 10:
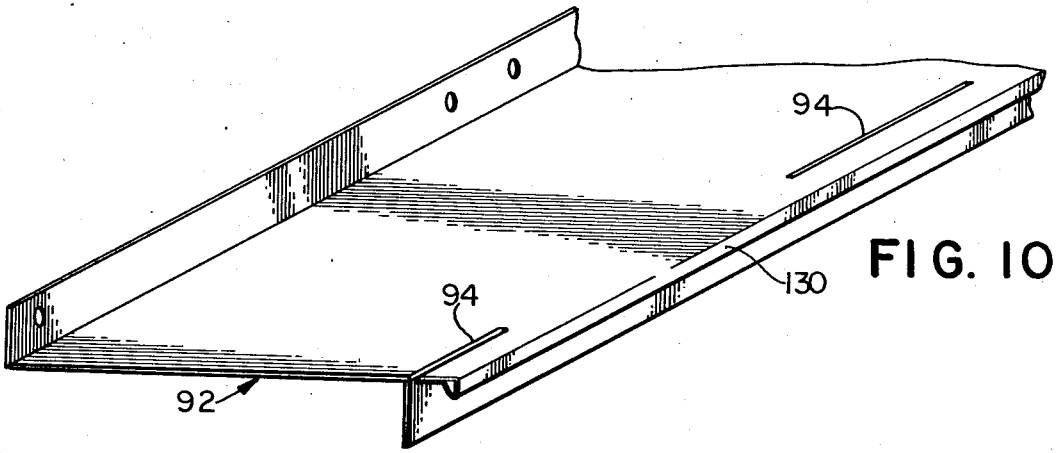
FIG. 10 is a perspective view of a siding starter member according to the invention.

Connection of the lowermost piece of siding to the channel is facilitated by adding a member having a downwardly directed projection for engaging an edge of a lowermost strip of the siding. This siding starter member 92, shown in FIG. 10, may also comprise the L-shaped portion for connection to the inner side of a stud. However, in order to include connecting bracket 96, openings 94 are provided along the length of starter strip 92. The openings occur at said spaced two-foot intervals which is the standard spacing of studs, as separated by the spreader bars. Accordingly, each of the parts is seen to be dimensioned to be fit on the job, without need for trimming or custom fitting, to incremental multiples of the basic repeating dimensions.

The particular fastening means for interconnecting channel members, adapters, siding, roofing and other portions of the structure can be of any convenient type. Screws, rivets or nut-and-bolt arrangements are possible. It is presently preferred that hex-head sheet metal screws be employed for most of the connections, which type which can be conveniently driven using electric drills having nut driver screw-engagement chucks. The connection holes are already provided at the incremental spacings in each of the interfitting members, and moreover, the connection hole align precisely at each of the increments. Therefore, no other holes need be provided and the user need only affix the connection members to pre-formed, pre-aligned holes in order to complete assembly.

It will be appreciated that the spacing of openings 94 in siding starter member 92 has the effect of positioning the studs 54, 56 precisely at the edge of the slab. A projecting nub 130 is provided on the starter strip, and likewise a nub is provided on each piece of siding and roofing to be interconnected in order to define the surface structure of the buiding. The nub is conveniently formed as a loop-like bend in the cross-section of the sheet metal strip. The interconnection is shown in cross-section in FIG. 3. Each piece of siding has a first edge which is dimensioned to fit over and engage projecting nub 130 along its length. Adjacent an opposite edge, each piece of siding and roofing has a structure which defines another similar projecting nub 130, for engagement by the successive piece of siding. Immediately beyond the projecting nub, at the extreme edge, is a flange for attachment directly to the stud, whereby the strips of siding are engaged to one another and also locked to the studs, providing a strong and attractive connection along the entire wall and/or roof. Siding strips 78 as shown are creased to define two separate slat portions, between connections to the stud, for example, adjacent projection 130. The slats simulate the appearance of wood siding, and may be of any desired width, or any multiple of slats between connecting points. Roofing 82 is preferably substantially flat between connecting nubs, providing a more traditional appearance reflecting conventional construction elements, namely roofing shingles.

An overhang is provided around the entire periphery of the structure by means of extensions on the joists, for the sides of the structure, and outward-directed gable extensions 114 along the ends. These elements are primarily for appearance and for protection from sun and rain. Therefore, their connections to underlying structural elements need not be extensive, as for supporting loads. Gable end brackets 114 are preferably attached to the endmost stud by means of angle iron or the like. The joist-extending brackets 140 are preferably simply sheet metal bodies having L-shaped cross-sections, the leg of the "L" being placed upon and attached over the upper surface of the eaves adapter 110, and connected the same as the remaining components. An additional suplementary flange 142, namely a short L-shaped member, is also attached at the opposite lower corner of extension 140, in order to provide a flat connection point on said lower corner for a fascia cover. Also attached thereto, and covering the joist end, is a piece of fascia similar to siding starter 92 which defines another projecting nub 130, for starting the interconnecting series of roofing portions 82.

FIG. 4 illustrates in detail the interconnection of covering elements at the junction of the joist extension 140 and the side stud 54. An angled flange bar 144 is attached to the top of stud 54 before the last layer of siding is affixed. The last layer of siding is then hooked over the upper projection and, together with an edge of fascia 84, is forced under the angled bracket 144, completing the connection at the junction. At the outer lower corner of joist extension 140, the fascia member is connected by means of an exposed screw to supporting flange 142, and end fascia portion 146. The end fascia portion is provided with a projecting structure 130, for starting the roofing connection on the upper side of extension 140. In this manner, the siding, fascia and roofing are attached together at the standard dimensional increments, and also attached to the underlying stud and joist extension structure, from the slab 90 to the roof ridge.

Figure 6:
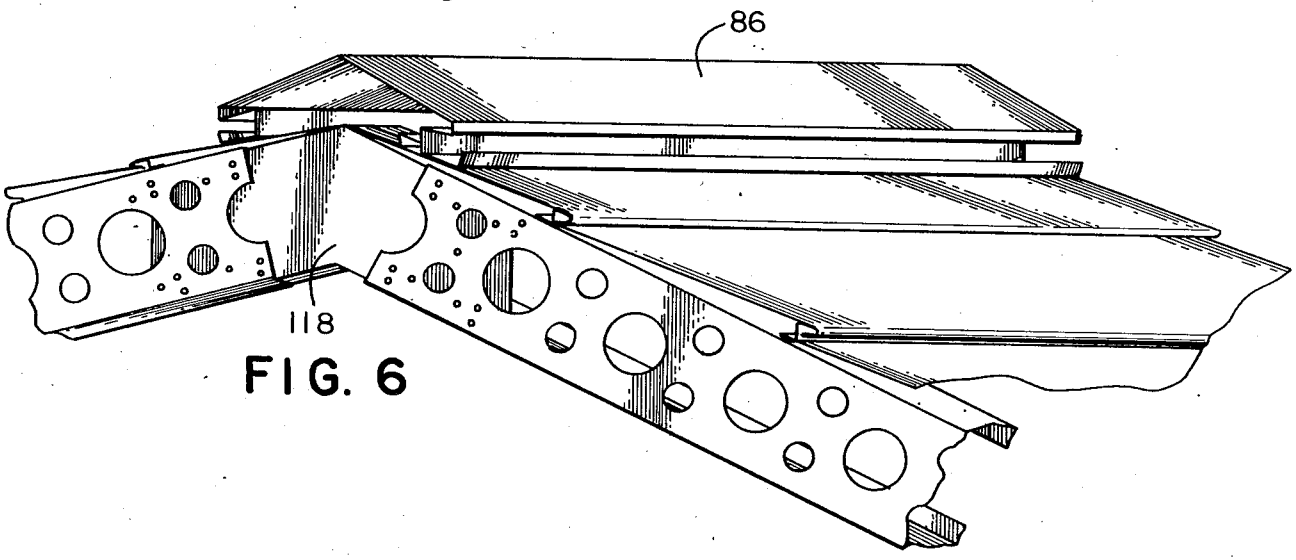
FIG. 6 is a partial perspective view of a stage of construction.
Figure 9:
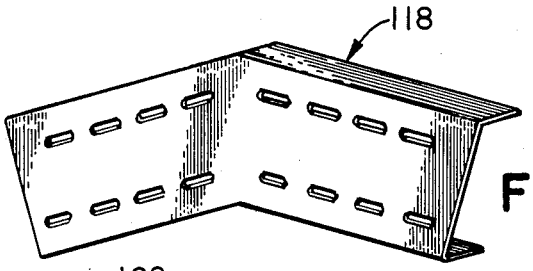
FIG. 9 is a perspective view of a roof ridge adapter according to the invention.

FIG. 6 illustrates the covering portion which completes the structure at the roof ridge. Ridge cap 86 overlaps the last projection of the uppermost pieces of roofing strip. The roofing strips, of course, define incremental lengths which progress from the joist extension 140 to the roof ridge. In order to seal the ridge, and accommodate the gap which remains between the uppermost roof strips and the precise ridge, ridge cap 86 is provided. The cap is wide enough to bridge at least one full roofing segment increment, thereby finishing the structure.

On the gable ends, extensions 114, which are short lengths of C-channel, function analogously to joist extensions 140, supporting fascia strips in the same manner, except requiring an angular connection due to the sloping nature of the gable overhang. It is presently preferred that the bottom edge of brackets 114 be provided with angular flanges for supporting fascia from below, and that the upper edge of fascia covering the ends of extensions 114 be allowed to overlap the roofing. Suitable sealing is recommended.

Framing at the corners, and around windows, doors and the like, is shown in FIGS. 15–21. As shown in FIG. 15, the corners of the structure are covered with a trim element 74, leaving an open plenum for use as a conduit or the like. End brackets 76 conceal the edges of siding 78. Similar end brackets are provided at the framing of doors and windows, which is accomplished using special studs 52. Studs 52 include a structure defining a stop 136 which is used, for example, to support a window structure, or to hold a door at closed position. FIG. 15 illustrates the use of window framing stud 52, and the engagement of siding 78 by means of end cover 76, which is merely a trim channel having an edge covering the edge of the siding.

FIGS. 16–18 show the framing of a door or window. Special studs 52, having a special cross-section with raised stops 136, define the opening of the door or window. An additional similar door or window header is attached horizontally, and has a downwardly directed stop 136. Along the width of the door or window, the usual studs 54 are provided and are endwise connected to the header bar. Connections may be made as shown by angle irons or the like.

Figure 8:
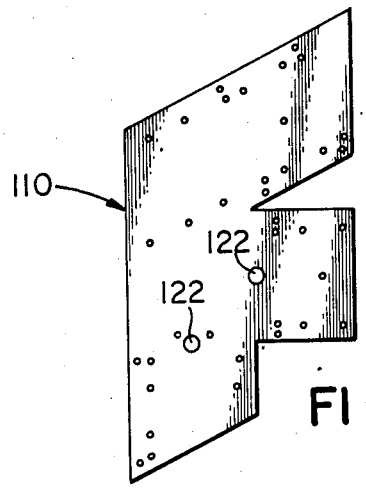
FIG. 8 is an elevation view of an eaves adapter according to the invention.

As shown in FIG. 8, the upper portion of window trim includes another siding starter 68, also having the usual projecting connection nub 130. If desired, siding starter 68 can be covered with an end cover 76, as used at the end of the siding strips.

Figure 20:
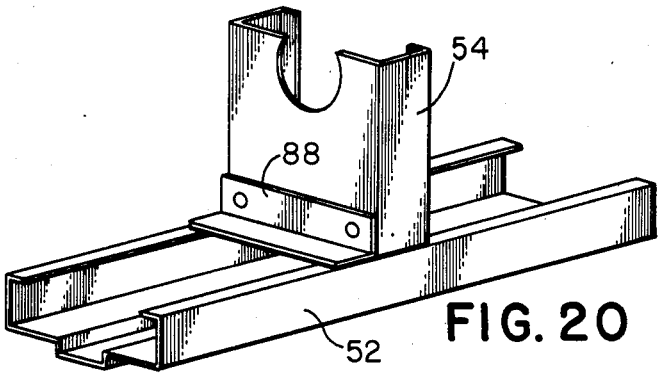
FIG. 20 is another elevation of a portion of door or window framing.
Figure 21:
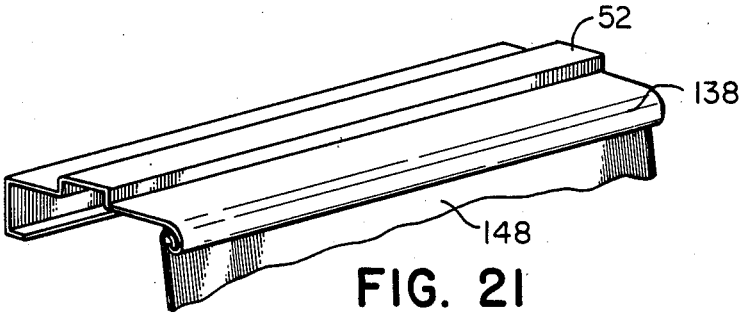
FIG. 21 is a perspective view of an interconnection of window framing and siding along a windowsill.
Figure 19:
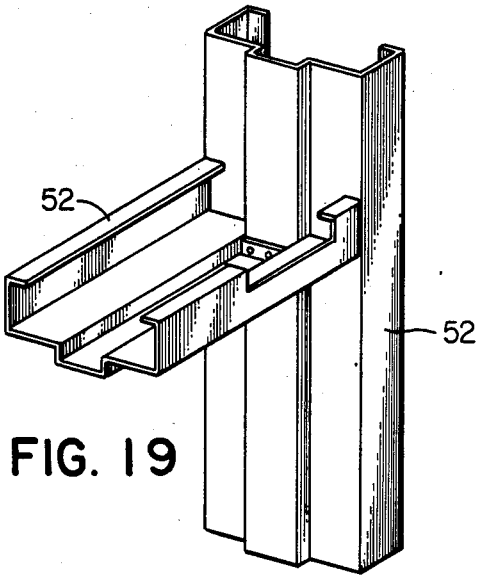
FIG. 19 is a perspective view of a section of door or window framing.

Perspective views illustrating the interconnection of the window framing studs 52, regular studs 54 and angle irons 88 are shown in FIGS. 19–21. With reference to FIG. 21, the stud frame element forming the sill for a window can be specially formed to include a rolled edge 138, which hooks over and engages a special piece of siding 148, thereby allowing connection of an upper edge of a siding strip without the need for a connection flange or projecting nub 130. Such a construction requires that the sill having rolled edge 138 be installed after the upper edge of siding is in place.

According to the foregoing description, the construction elements of the invention can be universally attached at any incremental size desired. Extremely large structures, or large multiple-story structures may at some point require the inclusion of additional vertical members to support the additional weight. It is believed that the metal studded construction according to the invention is perfectly adequate for supporting the load of traditional single-family dwellings, and also multiple-story buildings up to three or four stories. In the event that long header and gable beams are required, additional support may be had by use of trusses running between the joists and headers as in FIG. 12. For structures which are unusually large in a vertical direction, studs 54, 56 can be doubled or supplemented by a number of additional load-bearing members, such as along the headers in the enclosed portion of the structure.

Even if stretched to the design limitations of structural size, the system of the present invention is highly superior to traditional building elements in both strength and ease of manufacture and use. At the other end of the range of scales, the incremental interfitting nature of the parts of the invention make it well adapted for small scale uses including toy construction sets and the like. In such devices, the separable fasteners can be replaced by formed push-fit interfitting projections and cavities, also repeating at the basic dimensional increment. Such a small scale construction set can mirror the full scale system, being thereby useful as a training device for users, and as a means of trying new design ideas for buildings and for neighborhoods. The various elements of the invention can be formed from relatively light weight aluminum of about 20 gauge, extruded or easily bent from sheets of the metal. The parts may therefore be produced at a relatively low cost, which cost saving is made even more remarkable by the savings in labor costs during construction and the extreme durability of the resulting structure. The system has been described with reference to full scale metal parts, but it will be appreciated that other materials may also be used successfully. In addition to aluminum at 20 gauge, other thicknesses of aluminum, coated materials, steel or other metals, plastics or other structural products can be employed in suitable environments, in each case benefitting from the features of the invention.

The device of the invention is capable of a number of modifications without departing from the spirit thereof. Reference should be made to the appended claims rather than the foregoing specification as indicating the true scope of the invention.

What is claimed is:

1. A building constructed with a primary load-bearing frame structure erected on a foundation from sets of prefabricated structural members, comprising:

a plurality of girder members, adapted for horizontal, vertical and diagonal orientation in a primary load-bearing frame structure, the girder members forming studs, headers and joists depending upon the orientation thereof, each prefabricated with identical channel-shaped cross-sections of uniform web width and a repeating pattern of connection holes, the girders being formed in a plurality of lengths in increments corresponding to the size of the hole pattern;

a plurality of plate members, each prefabricated with at least two webs having the repeating pattern of connection holes formed therein, the respective webs of each girder and each plate member being dimensioned to enable the respective webs to abut one another in substantially flush engagement and with the respective patterns of connection holes in alignment with one another;

standardized attachment means rigidly engageable with the girder and plate members through the connection holes to provide full surface engagement of the web portions, whereby a plurality of frame structures for buildings, of varied size and shape, may be easily constructed from sets of prefabricated girder members and prefabricated plate members secured together by standardized attachment means, whereby primary loads are borne by and transmitted between the girder and plate members, the web portions bearing against one another to provide high rotational rigidity and overall frame stiffness; and, means for securing at least some of the girder members to a foundation.

2. The system of claim 1, further comprising:

means for holding the girder members at predetermined spaced intervals from one another;

siding strips for attachment to the studs; and, roofing strips for attachment to the joists, the siding strips and roofing strips each being dimensioned to multiples of a predetermined length and width, the predetermined length corresponding to multiples of the spaced intervals and the predetermined width corresponding to multiples of a dimension of the repeating pattern of connection holes, whereby the siding and roofing strips may be affixed directly to the girder members by the standardized attachment means.

3. The system of claim 1, further comprising at least one eaves bracket, said eaves bracket aligned with the joist and defining an extension of the joist over the stud, the bracket having openings adapted for alignment with the repeating holes for the engagement of standardized attachment means.

4. The system of claim 1, further comprising spreaders attachable perpendicularly to the studs and headers, the spreaders spacing the studs and headers to define a skeleton for supporting the siding and roofing.

5. The system of claim 1, further comprising a starter member for endwise attaching the girder members to a concrete slab, the starter member having flanges for receiving attachment means, the flanges defining a receiving channel for receiving ends of the girder members, the starter member being engageable with the slab.

6. The system of claim 5, wherein said starter member has a protruding engagement structure having a hook-shaped cross-section, the engagement structure extending away from the girder members and being directed downwardly.

7. The system of claim 6, further comprising a plurality of siding strips, each of said strips having engagement structure comprising an upper edge of hook-shaped cross-section, extending from said upper edge and directed downwardly, said upper edge also having means for attachment to the channel members, the strips having a lower edge dimensioned to fit the hook-shaped cross-section of the engagement structure of an adjacent strip or starter member, whereby said strips can be attached to said starter member, interattached and attached to said girder members along the studs.

8. The system of claim 7, further comprising an eaves starter piece with engagement structure having an upper hook-shaped cross-section aligned outwardly with respect to the joist, and roofing strips having a first, lower edge dimensioned to fit the hook-shaped cross-section of the engagement structure and a second, upper edge, having means for attachment to the joists and hook-shaped engagement structure for engaging the first, lower edge of an adjacent roofing strip.

9. The system of claim 8, further comprising a ridge cap for covering a last upper strip of roofing adjacent a junction of said joists, the ridge cap being at least as wide as a roofing strip, the ridge cap having openings adapted for alignment with the repeating pattern of connection holes for the engagement of standardized attachment means.

10. The system of claim 1, further comprising means for attaching said girder members perpendicularly along the length thereof, whereby studs are formed along ends and corners of said studs and headers.

* * * * *